US009734960B2

(12) United States Patent
Zhukowski et al.

(10) Patent No.: US 9,734,960 B2
(45) Date of Patent: Aug. 15, 2017

(54) SWITCHING DEVICE HAVING AN APPARATUS FOR SWITCHING ON SUDDENLY

(71) Applicant: Siemens Aktiengesellschaft, Munich (DE)

(72) Inventors: Alexander Zhukowski, Amberg (DE); Tobias Kemptner, Fensterbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/021,120

(22) PCT Filed: Sep. 25, 2013

(86) PCT No.: PCT/EP2013/069972
§ 371 (c)(1),
(2) Date: Mar. 10, 2016

(87) PCT Pub. No.: WO2015/043632
PCT Pub. Date: Apr. 2, 2015

(65) Prior Publication Data

US 2016/0225547 A1 Aug. 4, 2016

(51) Int. Cl.
*H01H 1/52* (2006.01)
*H01H 3/20* (2006.01)
(Continued)

(52) U.S. Cl.
CPC ..... *H01H 9/20* (2013.01); *H01H 1/50* (2013.01); *H01H 71/50* (2013.01);
(Continued)

(58) Field of Classification Search
CPC H01H 9/20; H01H 1/50; H01H 71/50; H01H 71/56; H01H 73/045; H01H 2300/046; H01H 3/00; H01H 3/02; H01H 3/04; H01H 3/32; H01H 3/46; H01H 3/54; H01H 71/00; H01H 71/10; H01H 71/1072;
(Continued)

(56) References Cited

U.S. PATENT DOCUMENTS

2011/0005906 A1* 1/2011 Dupraz ..... H01H 3/38 200/50.24

FOREIGN PATENT DOCUMENTS

CN 102214530 10/2011
DE 19703977 C1 5/1998
(Continued)

OTHER PUBLICATIONS

Office Action dated Nov. 28, 2016 which issued in the corresponding Chinese Patent Application No. 201380077922.6.

*Primary Examiner* — Anthony R. Jimenez
(74) *Attorney, Agent, or Firm* — Cozen O'Connor

(57) ABSTRACT

A switching device and apparatus for switching on suddenly has an actuating mechanism element operatively connected to a latching mechanism by a transmission mechanism, The latching mechanism operates a switching lever through a further transmission mechanism. A contact assembly has a fixed switching piece facing a moveable switching piece that is guided in a contact slide. In the latching mechanism, a lever is arranged in operative connection with a locking part that is operatively connected to a transmission element which acts on the moveable switching piece.

11 Claims, 10 Drawing Sheets

(51) Int. Cl.

| | |
|---|---|
| ***H01H 9/00*** | (2006.01) |
| ***H01H 9/20*** | (2006.01) |
| ***H01H 1/50*** | (2006.01) |
| ***H01H 71/50*** | (2006.01) |
| ***H01H 73/04*** | (2006.01) |
| *H01H 71/56* | (2006.01) |

(52) U.S. Cl.
CPC ..... *H01H 73/045* (2013.01); *H01H 71/56* (2013.01); *H01H 2300/046* (2013.01)

(58) Field of Classification Search
CPC .. H01H 71/501; H01H 71/52; H01H 2003/00; H01H 71/02; H01H 2221/00; H01H 2221/002; H01H 2221/004; H01H 2221/016; H01H 2221/024; H01H 2221/032; H01H 2221/054; H01H 2221/058
USPC ..... 200/318, 329, 335, 332, 61.91, 239
See application file for complete search history.

(56) References Cited

FOREIGN PATENT DOCUMENTS

| | | | |
|---|---|---|---|
| EP | 0325501 | A1 | 7/1989 |
| EP | 0362871 | A2 | 4/1990 |
| EP | 0568881 | A1 | 11/1993 |
| EP | 2023368 | A1 | 2/2009 |

* cited by examiner

SWITCHING DEVICE HAVING AN APPARATUS FOR SWITCHING ON SUDDENLY

FIELD OF THE INVENTION

The present invention relates to a switching device comprising a device for sudden switching-on, including an operating mechanism with an operating element and operatively connected by means of a transmission mechanism to a latching mechanism that operates a switching lever by means of a further transmission mechanism, and having a contact arrangement that has a fixed switching piece with contacts arranged opposite a moveable switching piece with contacts and which is guided for movement in a contact slide.

BACKGROUND OF THE INVENTION

Switching devices, in particular circuit breakers, serve amongst other things for safely switching-off power in the event of a short circuit and are in this way operable to protect electric load installations. Electrical or mechanical switching units are furthermore suitable for operational manual switching of loads and also for safely disconnecting an installation from the power supply system during servicing work or while modifications are being made to the installation. Electrical switching units are often operated electromagnetically.

Switching units of this kind are technically thus high-quality electrical switching devices with integrated protection for motors, lines, transformers and generators. Such switching units are specifically used at functional locations with a relatively low switching frequency. In addition to short-circuit protection, switching units of this kind are also suitable for overload protection.

In the event of a short circuit, an electrical switching unit safely switches off an electrical installation. Therefore, this electrical switching unit provides safety protection from overload. Any conductor through which current is flowing is heated to a greater or lesser extent. The heating is in this case dependent on the ratio of the current intensity to the conductor cross section, the so-called current density. The current density should not become too great since, otherwise, the conductor insulation can be scorched by excessive heating and a fire may be triggered. In order to protect electrical installations from these damaging effects, switching units are used as overcurrent protection devices.

Circuit breakers have two release mechanisms which act independently of one another for overload and short-circuit protection. Both release mechanisms are connected in series. An electrical release that acts virtually without any time delay performs the function of protection in the event of a short circuit. In response to a short circuit, the electromagnetic release unlatches a latching mechanism of the circuit breaker without any delay. A switching armature isolates the switching piece before the short-circuit current can reach its maximum value.

Known switching units have a contact slide unit comprising a contact slide and a moveable switching piece which, in turn, has electrical contacts. Such switching units also have first contacts to an electrical line. In a switched-on state, the electrical contacts of the moveable switching piece make contact with the fixed contacts of the switching unit. In the event of a short circuit, the electrical contacts of the moveable switching piece are released from the fixed contacts, thereby interrupting the flow of electrical current as the moving switching piece is released from engagement with the fixed contacts.

In addition to their protective functions as overload and short-circuit releases as mentioned above, circuit breakers are also commonly used to switch on and switch off motors. In order to demonstrate this function, the circuit breakers must be able to switch on ten times the motor rated current according to the product standard. To be able to ensure this limit loading, the circuit breaker must close the double break of the three current paths in the form of, in each case, one moving bridge with two contact points and two fixed contact points at virtually the same time and in a step function.

To realize this functionality, the contact apparatus comprising a contact slide and a moving bridge is released by means of a manually operated mechanism in the form of an operating element, a latching mechanism and an operating chain. The release operation takes place in a so-called rapid connection operation, or more precisely a spontaneous or sudden connection operation. In this case, the three contact systems are released by a mechanism only after the latching mechanism has already been switched on. The spring store in the form of a contact load spring then determines the kinematics of the contact system during the switching-on operation.

After the bridges strike the fixed switching pieces, the contact slide accelerates until it is reflected or redirected or rebounded at a stop. The reflection and the resulting kinetic energy of the contact slide result in renewed opening of the contact system. This can lead to welding phenomena in the event of a simultaneously elevated current in the current path.

OBJECTS AND SUMMARY OF THE INVENTION

It is accordingly an object of the invention to provide a switching device that includes a device for sudden switching-on, wherein the switching device avoids contact lift-off with possible contact welding.

In accordance with the invention, this object is achieved by a switching device comprising a device for sudden switching-on, which device includes an operating mechanism which has an operating element and is operatively connected to a latching mechanism by means of a transmission mechanism. The latching mechanism operates a switching lever by means of a further transmission mechanism, and the switching device further includes a contact arrangement that has a fixed switching piece having fixed contacts and arranged opposite a moveable switching piece having contacts and guided for movement in a contact slide. The device for sudden switching-on has a lever that is arranged in the latching mechanism and in operative connection with a locking part that is operatively connected to a transmission element which acts on the moveable switching piece of the contact arrangement.

In the case of a three-pole switching device, in particular a circuit breaker, the three contact apparatuses formed of moveable and fixed switching pieces are pushed into the switched-off position by means of a finger-like switching lever. This arrangement is associated with a defined distance "a" between the moveable and fixed switching pieces. When the operating element is operated, the latching mechanism, by way of its lever which undergoes a rotary movement, begins to release the transmission element and therefore the contact apparatus. After an initial movement, the lever forces the locking part to follow its rotary movement since the two parts have the same mounting point. After passing through the rotation angle, the locking part blocks the transmission element, so that the contact distance between the moving switching piece and the fixed switching piece now corresponds to a distance "b". The distance "b" is held constant until the locking part has moved through a distance "c" on the transmission element. While the transmission element blocks the contact apparatus, the lever continues its rotary movement. After the locking part has passed through the distance "c", the transmission element is released so that the contact apparatus can close the current path independently of the rotary movement of the operating part. Constant release of the transmission element is performed owing to the forced guidance of the locking part on the switching lever.

The essence of the invention is that the switching-on process takes place independently of the rotary movement on the operator control part. The distance "c" determines the time for which the contact distance "b" is maintained. During this time period, the operator control part is moved to the switched-on position, so that closing of the current path is not determined by the rotary movement on the operator control part, but rather by the dynamics of the contact apparatus and the contact load spring of the contact apparatus. This further leads to there being no time deviation between the individual current paths when they are closed. Owing to the spontaneous or sudden switching-on operation, the contact load springs determine the dynamics of the moving switching pieces and not the rotary movement of the operator control part. And owing to the narrow tolerance band of the contact load spring, the approximately constant weight of the bridges and of the contact slide, the current paths are closed virtually at the same time. As a result, arcs and, welding phenomena can be avoided. This results in an increase in the switching-on rated current. The forced guidance between the lever and the locking part leads to a constant time sequence of the switching-on process and to a small tolerance chain and, therefore, to a high level of accuracy for the distance "b". The respective switching device can be fitted with a corresponding locking part in a device-specific manner.

The device according to the invention for sudden switching-on is distinguished by three components that are operatively connected to one another. The lever of the invention is part of the latching mechanism and preferably has two limbs that are connected to one another by a connecting web. The limbs are preferably at a 90° angle in relation to the connecting web. One of the limbs has two relatively large and two relatively small passage holes, the two relatively small passage holes preferably being arranged above and below one of the two relatively large holes and being designed to receive the two ends of a spring element. The other limb at the end of the connecting web is preferably formed with a full surface area. A further relatively small limb is preferably arranged between the limbs and is connected by means of a further connecting web to the limb which does not have a full surface area. This third limb is preferably formed parallel to the two other limbs and has a passage hole which, in the assembled state of the switching device, is arranged in the same position relative to the lower, relatively large passage hole in that limb which does not have a full surface area.

The locking part of the invention has a wedge-shaped component from which preferably two limbs preferably project toward the same side, wherein one limb has a passage hole and is slightly rounded, and the other limb is formed with a full surface area and is slightly wedge-shaped. A preferably semi-concentric projection is arranged at the tip of the limb that has a full surface area. The locking part is positioned on the lever by the passage hole in the limb of the locking part being positioned on the passage hole in the small limb of the lever, so that the lever and the locking part are mounted at the same mounting point. Owing to this identical mounting, thr limb of the locking part that has a full surface area is positioned below that limb of the lever that has a full surface area.

The transmission element of the invention has a rear wall surface area that is preferably virtually planar and from which two side walls project toward the same side. The side walls each have a region, the regions being disposed at a distance from one another and in parallel relation to one another, and a tapering region in which the side walls are formed such that they taper toward one another. A connecting web is formed at the transition between the parallel region of the side wall and the tapering region of the side wall. The tapering region of the side wall opens into two relatively short limbs that are arranged in parallel relation to one another, and two relatively long limbs that are arranged in parallel relation to one another, at a distance from one another, and below the connecting web, and are formed in the switching device in the direction of the contact arrangement.

The regions of the side wall that are formed in parallel relation to one another are arranged above the connecting web in the direction of the latching mechanism. In this case, one of the two parallel sidewalls is smaller than the other and has a beveled surface that is operatively connected to the wedge-shaped component of the locking part in the switching device. The tip of the wedge-shaped component of the locking part passes across the beveled surface of the side wall of the transmission element until, in the switched-on position of the switching device, it comes to rest, by way of the rear face of that limb of the locking part which has a full surface area, on the beveled surface of the side wall of the transmission element.

The invention is distinguished in that the switching-on process takes place independently of the rotary movement on the operator control part. Owing to the sudden switching-on operation, the contact load springs determine the dynamics of the moveable switching pieces, and not the rotary movement of the operator control part. Owing to the narrow tolerance band of the contact load spring, the approximately constant weight of the bridges and of the contact slide, the current paths are closed at virtually the same time. As a result, arcs and welding phenomena can be avoided. The forced guidance of the invention between the lever and the locking part leads to a constant time sequence of the switching-on process and to a small tolerance chain. The locking part can be designed in a device-specific manner.

Further advantages and embodiments of the invention will be explained with reference to an exemplary embodiment and with reference to the drawings.

BRIEF DESCRIPTION OF THE DRAWINGS

In the drawings:

FIG. 1 is an elevated front perspective view of a lever in accordance with the invention of the device for sudden switching-on;

FIG. 4 is an elevated perspective front view of a locking part according to the invention of the device for sudden switching-on;

DETAILED DESCRIPTION OF THE PREFERRED EMBODIMENTS

Figure 1:
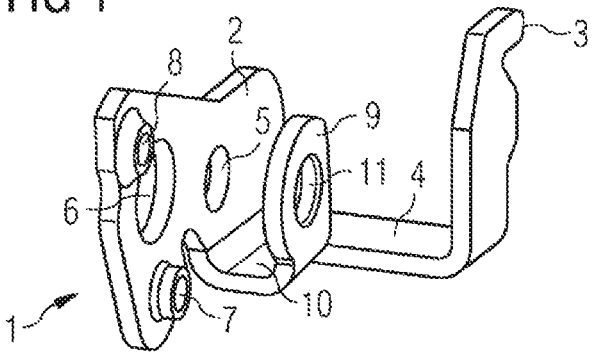

FIG. 1 depicts a lever 1 in accordance with the invention of a device for suddenly switching on a switching device. The lever 1 preferably has two limbs 2, 3 that are connected to one another by a connecting web 4. The limbs 2, 3 are preferably oriented at a 90° angle in relation to the connecting web 4. The limb 2 has two relatively large passage holes 5, 6 and two relatively smaller passage holes 7, 8, the two relatively smaller passage holes preferably being arranged above and below the larger passage hole 6. The limb 3 at the end of connecting web 4 is preferably formed with a full surface area relative to the limb 2. A further relatively small limb 9 that is connected, by a further connecting web 10, to the limb 2 that does not have a full surface area is preferably arranged between the limbs 2, 3. This third limb 9 is preferably oriented in parallel relation to the two limbs 2, 3 and has a passage hole 11 which, in the assembled state of the switching device, is arranged in the same position as the lower, relatively large passage hole 5 in the limb 2 that does not have a full surface area.

Figure 2:
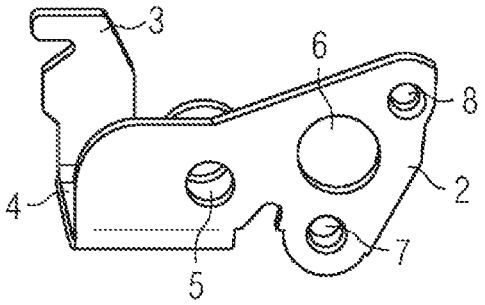
FIG. 2 is a perspective side view of the lever of FIG. 1.

FIG. 2 shows a side view of the lever 1 of the invention, and more clearly depicts the passage holes 5, 6, 7, 8 in the limb 2 and the positions of the limbs 2, 3 in relation to one another.

Figure 3:
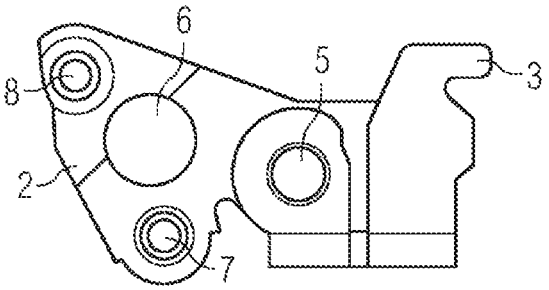
FIG. 3 is a perspective view of the lever of FIGS. 1 and 2.

FIG. 3 similarly illustrates a further side view of the lever 1. The passage holes 7, 8 in limb 2 are used to receive the two ends of a spring element in the assembled state of the switching device.

Figure 4:
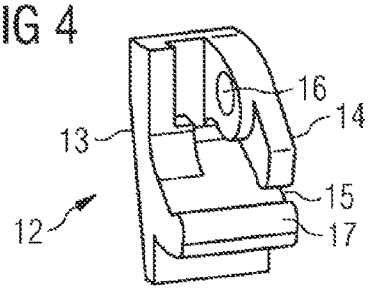

FIG. 4 depicts a locking part 12 according to the invention of the device for sudden switching-on. The locking part 12 has a wedge-shaped component 13 from which preferably two limbs 14, 15 project, preferably toward the same side, wherein one of the limbs 14 has a passage hole 16 and is slightly rounded, and the other limb 15 is formed with a full surface area and is slightly wedge-shaped. A preferably semi-concentric projection 17 is arranged at the tip of the limb 15 that has a full surface area. The locking part 12 is positioned on the lever 1 by aligning the passage hole 16 in the limb 14 of locking part 12 with the passage hole 11 in the small limb 9 of lever 1, so that lever 1 and locking part 12 are mounted at the same mounting point. By virtue of this identical mounting, the limb 15 of locking part 12 that has a full surface area is positioned below the limb 3 of lever 1 that has a full surface area.

Figure 5:
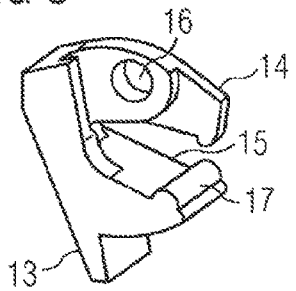
FIG. 5 is an elevated perspective side view of the locking part of FIG. 4.
Figure 6:
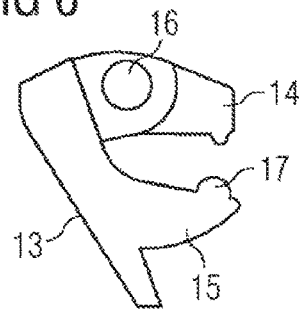
FIG. 6 is a side view of the locking part of FIGS. 4 and 5.
Figure 7:
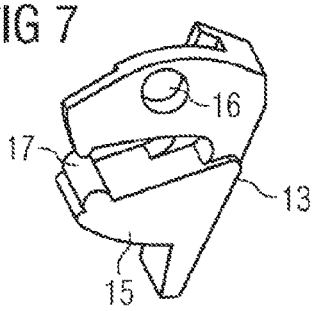
FIG. 7 is an elevated perspective side view of the locking part of FIGS. 4 to 6.

FIGS. 5 to 7 show different side views of locking part 12. These figures clearly show, in particular, the passage hole 16 in limb 14, the semi-cylindrical projection 17 of limb 15, and the wedge-shaped design of the wedge-shaped component 13.

Figure 8:
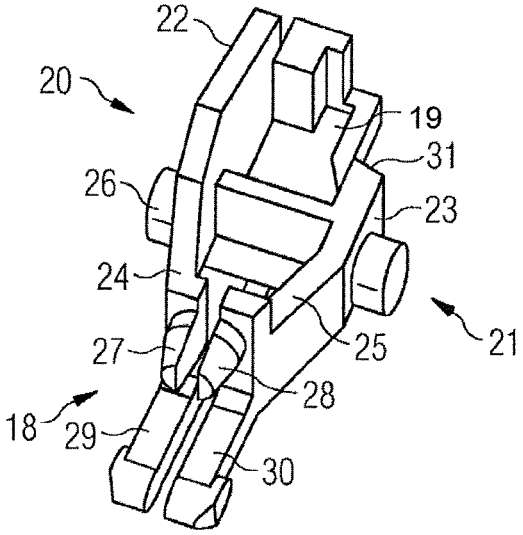
FIG. 8 is an elevated perspective front view of a transmission element according to the invention of the device for sudden switching-on of a switching device.

FIG. 8 depicts a transmission element 18 according to the invention of the device for sudden switching-on. Transmission element 18 has a rear wall surface area 19 which is preferably virtually planar and from which two side walls 20, 21 project toward the same side. The side walls 20, 21 each have a respective region 22, 23 disposed at a distance from and in parallel relation to one another, and in each case a respective tapering region 24, 25 in which the side walls 20, 21 are oriented so that they taper toward one another. A connecting web 26 is formed at the transition between the parallel regions 22, 23 of the side walls 20, 21 and the tapering regions 24, 25 of the side walls 20, 21. The tapering regions 24, 25 of the side walls 20, 21 open into two relatively short limbs 27, 28 that are arranged in parallel relation to one another and two relatively long limbs 29, 30 that are arranged in parallel relation to and at a distance from one another and are below the connecting web 26, and that are formed in the switching device in the direction of the contact arrangement.

The regions 22, 23 of the side walls 20, 21 that are oriented in parallel relation to one another are arranged above the connecting web 26 in the direction of the latching mechanism. The side wall 21 is smaller than the side wall 20 and has a beveled surface 31 that is operatively connected in the switching device to the wedge-shaped component 13 of locking part 12. The tip of the wedge-shaped component 13 of locking part 12 passes across the beveled surface 31 of the side wall 21 of transmission element 18 until, in the switched-on position of the switching device, the rear face of the limb 15 of locking part 12 that has a full surface area comes to rest on the beveled surface 31 of the side wall 21 of transmission element 18.

Figure 9:
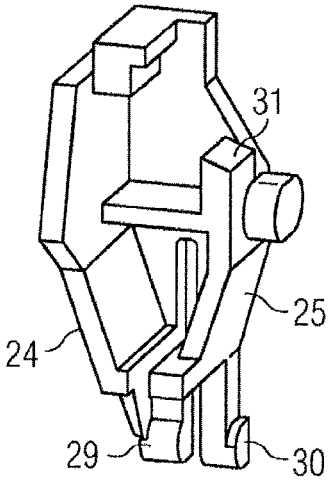
FIG. 9 is an elevated perspective top view of the transmission element of FIG. 8.
Figure 10:
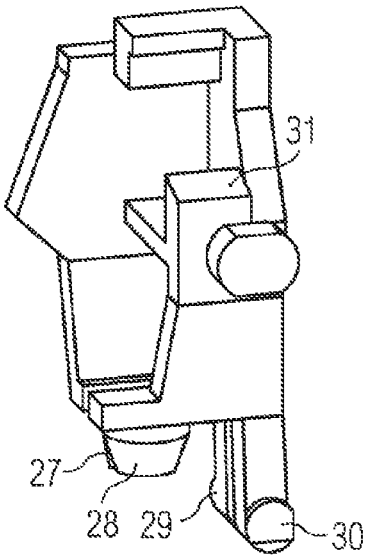
FIG. 10 is a perspective side view of the transmission element of FIGS. 8 and 9.
Figure 11:
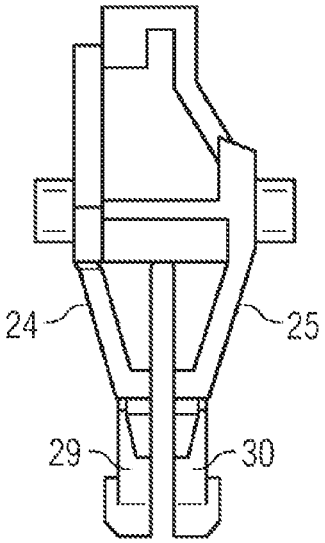
FIG. 11 is a rear view of the transmission element of FIGS. 8 to 10.

FIGS. 9 to 11 depict different views of transmission element 18 of the invention; FIGS. 9 and 10 in particular show the beveled surface 31.

Figure 12:
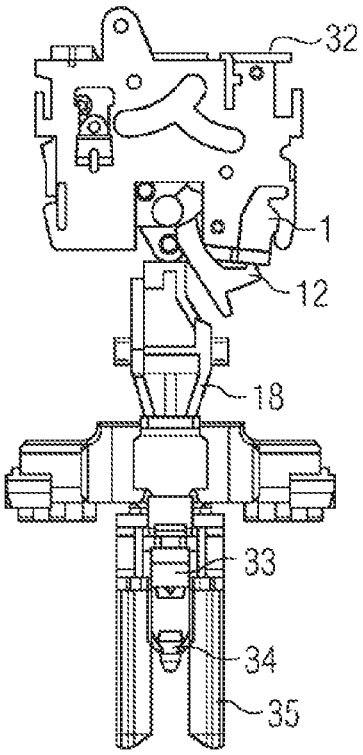
FIG. 12 is a sectional view of a latching mechanism of a switching device that is operatively connected to a device according to the invention for sudden switching-on, and a contact arrangement in the switched-off position.

FIG. 12 illustrates a latching mechanism 32 of a switching device that is operatively connected to the inventive device for sudden switching-on, and a contact arrangement in the switched-off position. The contact arrangement has a fixed switching piece 33 and a moveable switching piece 34 that is guided in a contact slide 35. The lever 1 is arranged in the latching mechanism 32, and is operatively connected to the locking element 12 which is disposed at a distance from transmission element 18 in the switched-off position. The moveable switching piece 34 is also disposed at a distance from fixed switching piece 33 in the switched-off position.

Figure 13:
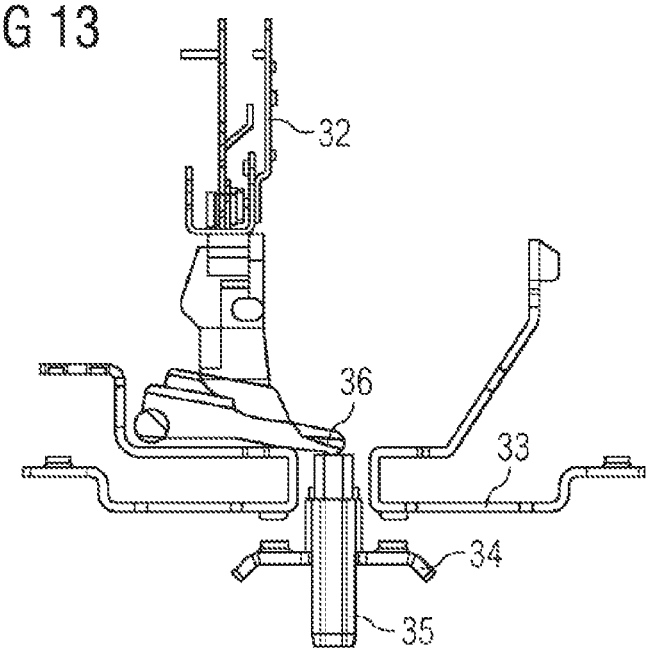
FIG. 13 is a sectional view of the latching mechanism and the contact arrangement of FIG. 12 in the switched-off position.

FIG. 13 shows the latching mechanism 32 that acts on the switching lever 36 that is operatively connected to the moveable switching piece 34. The switched-off state of the switching device is depicted in FIG. 13.

Figure 14:
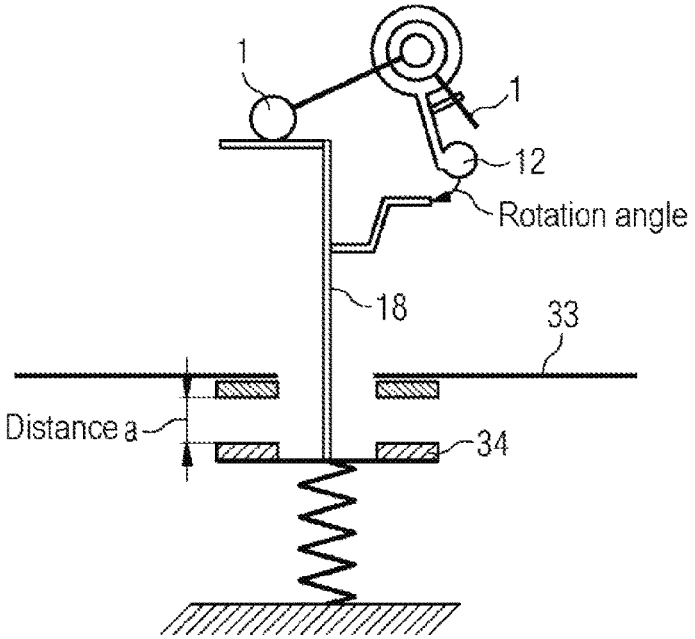
FIG. 14 is a schematic depiction of a device according to the invention for sudden switching-on having a contact arrangement shown in the switched-off position.

FIG. 14 is a schematic illustration of the inventive device for sudden switching-on, including a contact arrangement. FIG. 14 shows the defined distance "a" which is defined by the spacing between the moveable switching piece 34 and the fixed switching piece 33. The figure further shows that the locking part 12 passes through a rotation angle to the transmission element 18 in the event of a release.

Figure 15:
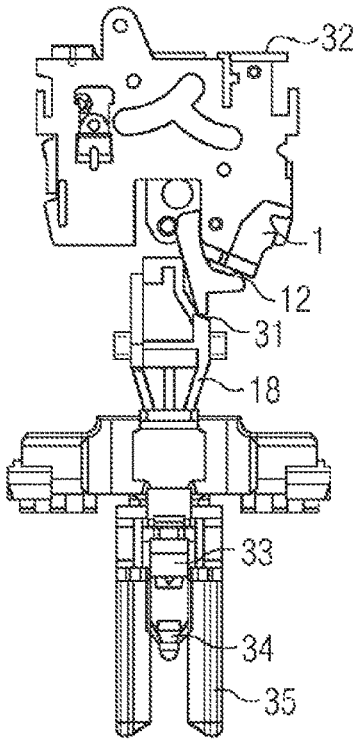
FIG. 15 is a sectional view of a latching mechanism of a switching device that is operatively connected to a device according to the invention for sudden switching-on, and a contact arrangement in the hold-open position.

FIG. 15 depicts the latching mechanism 32 with the inventive device for sudden switching-on and the contact arrangement in the hold-open position. In this position, the moveable switching piece 34 is still disposed at a distance from fixed switching piece 32, although that distance has been reduced in comparison to the switched-off position of the switching device. The lever 1 that is arranged in latching mechanism 32 executes a rotary movement in the hold-open position, the locking part 12 also being moved by this rotary motion, specifically in the direction of the beveled surface 31 of transmission element 18. In the hold-open position, the tip of the wedge-shaped component 13 of locking part 12 passes across the beveled surface 31 of transmission element 18.

Figure 16:
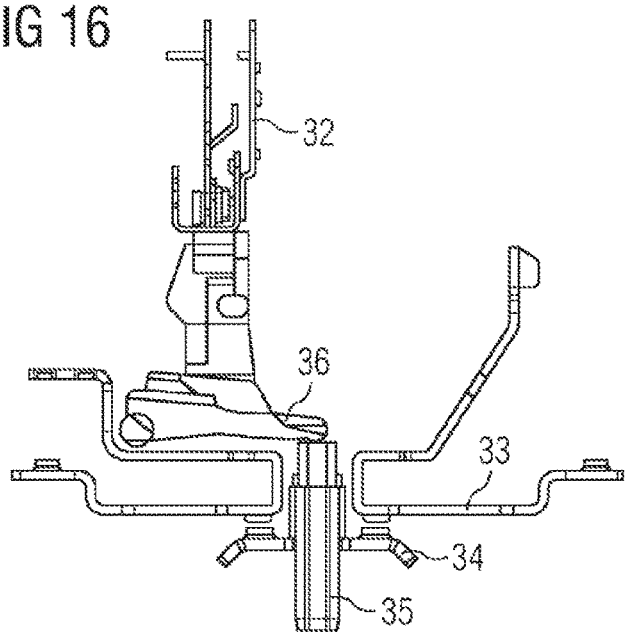
FIG. 16 is a sectional view of the latching mechanism and the contact arrangement of FIG. 15 in the hold-open position.

In FIG. 16, the operative connection of latching mechanism 32 to switching lever 36 is seen in the hold-open position. The relatively short distance or spacing between the switching pieces 33, 34 is also evident in this figure.

Figure 17:
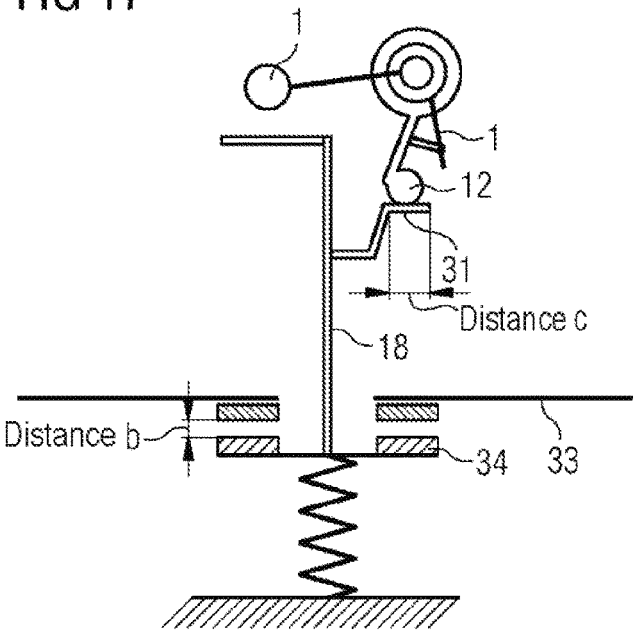
FIG. 17 is a schematic depiction of a device according to the invention for sudden switching-on with the contact arrangement shown in the hold-open position.

FIG. 17 is a schematic illustration of the inventive device for sudden switching-on including the contact arrangements. The defined distance "b" being the reduced distance between the moveable switching piece 34 and the fixed switching piece 33 is shown in the hold-open position. Also apparent in this figure is that the locking part 12 has now moved onto the beveled surface 31 of transmission element 18. FIG. 17 additionally depicts the defined distance "c" of the beveled surface 31 of transmission element 18.

Figure 18:
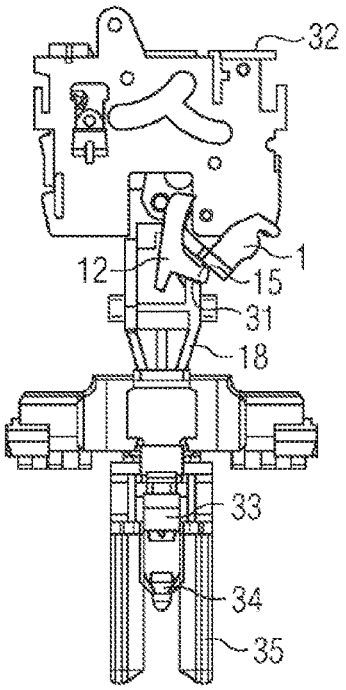
FIG. 18 is a sectional view of a latching mechanism of a switching device that is operatively connected to a device according to the invention for sudden switching-on, and a contact arrangement shown in the switched-on position.

FIG. 18 depicts the latching mechanism 32 of the switching device that is operatively connected to the inventive device for sudden switching-on, and the associated contact arrangement in the switched-on position. In this position, the moveable switching piece 34 now lies on the fixed switching piece 33. Lever 1 has now executed a further rotary movement on account of which locking part 12 has also been further rotated. Owing to the rotary motion of locking part 12, the rear face of the limb 15 of locking part 12 now lies on the beveled surface 31 of transmission element 18.

Figure 19:
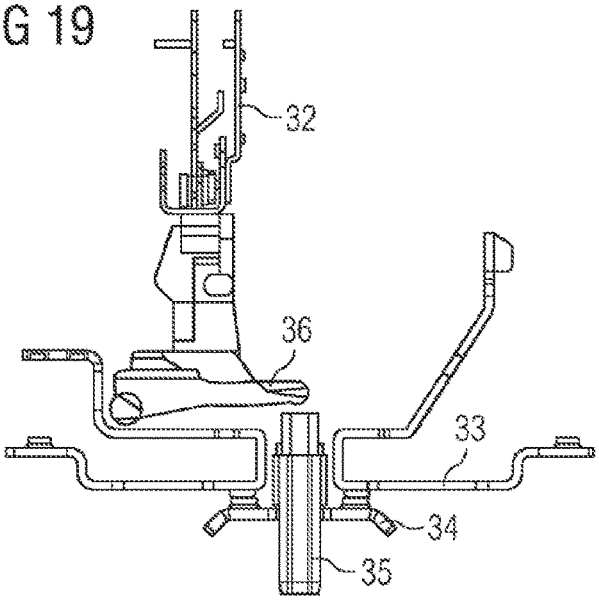
FIG. 19 is a sectional view of the latching mechanism and the contact arrangement of FIG. 18 in the switched-on position.

FIG. 19 shows the latching mechanism 32 that acts on switching lever 36, specifically so that switching lever 36 now no longer has any point of switching lever contact with the contact slide. The moveable switching piece 34 now lies on the fixed switching piece 33.

Figure 20:
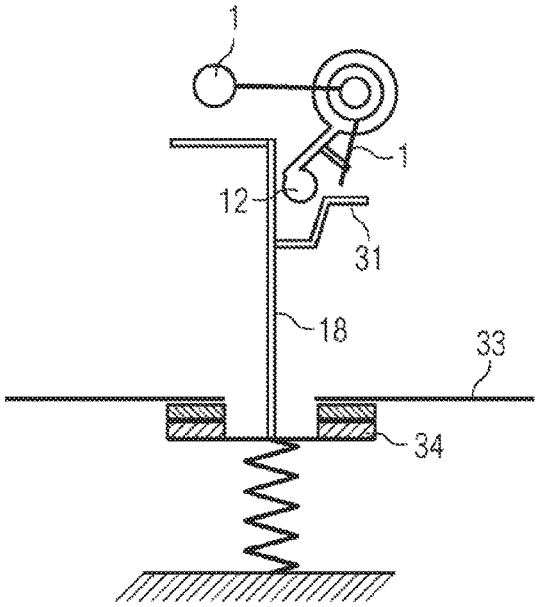
FIG. 20 is a schematic depiction of a device according to the invention for sudden switching-on with the contact arrangement shown in the switched-on position.

FIG. 20 is a schematic illustration of the inventive device for sudden switching-on and having a contact arrangement. As there seen, the further rotary movement of locking part 12 now leads to locking part 12 being arranged behind the beveled surface 31 in the switched-on position.

The present invention is distinguished in that the switch-on process takes place independently of the rotary movement on the operator control part. By reason of the sudden switching-on operation, the contact load springs determine the dynamics of the moveable switching pieces and not the rotary movement of the operator control part. By virtue of the narrow tolerance band of the contact load spring, the approximately constant weight of the bridges and of the contact slide, the current paths are closed at virtually the same time. As a result, arcs and welding phenomena can be avoided. The forced guidance provided by the invention between the lever and the locking part leads to a constant time sequence of the switching-on process and to a small tolerance chain. The locking part of the invention can be designed in a device-specific manner.

The invention claimed is:

1. A switching device configured for sudden switching-on operation and including an operating mechanism having an operating element and connected by a first transmission mechanism to a latching mechanism for operating a switching lever via a second transmission mechanism, and a contact arrangement formed of a fixed switching piece having first contacts and arranged opposite a moveable switching piece having second contacts and guided for movement in a contact slide, the switching device further comprising:

a device for sudden switching-on of the switching device, arranged in the latching mechanism and comprising a locking part, a lever arranged in operative connection with the locking part, said lever having first and second limbs connected by a connecting web, the first limb defining two larger passage holes and two smaller passage holes arranged respectively above and below one of the larger passage holes, and a transmission element operatively connected to the locking part and arranged to act on the moveable switching piece of the contact arrangement.

2. The switching device of claim 1, wherein the lever has a limb and a passage hole defined in the lever limb;

wherein the locking part has a limb and a passage hole defined in the locking part limb; and wherein the locking part is positioned on the lever by aligning the passage hole on the limb of the locking part and the passage hole on the limb of the lever so that the lever and the locking part are mounted on a common axis through the locking part passage hole and the lever passage hole.

3. The switching device of claim 1, wherein the switching device comprises a circuit breaker.

4. The switching device of claim 1, wherein the first and second limbs are arranged at a 90° angle relative to each other.

5. The switching device of claim 1, wherein the lever has a third limb arranged between the first and second limbs and connected to the first limb by a second connecting web.

6. The switching device of claim 5, wherein the third limb is disposed in parallel relation to the first and second limbs and defines a further passage hole that, in an assembled condition of the switching device, is aligned with one of the two larger passage holes in the first limb.

7. The switching device of claim 1, wherein the locking part has a wedge-shaped component from which two limbs project on a same side of the wedge-shaped component.

8. The switching device of claim 7, wherein one of the limbs of the locking part defines a limb passage hole therethrough.

9. The switching device of claim 1, wherein the locking part has a wedge-shaped component; and wherein the transmission element has a side wall with a beveled surface that is operatively connected to the wedge-shaped component of the locking part.

10. The switching device of claim 9, wherein the locking part has a limb; and wherein, in an operating state of the switching device, a tip of the wedge-shaped component of the locking part slides over the beveled surface of the transmission element and then, in a switched-on position, a rear face of the locking part limb comes to rest on the side wall of the transmission element.

11. The switching device of claim 10, wherein the contact arrangement further includes a contact load spring, and wherein the beveled surface of the side wall of the transmission element defines a distance and, thereby, a predetermined time period in which the switching device is moved to the switched-on position so that closing of a current path switchable by the switching device is determined independently of an operator of the switching device by dynamics of the contact arrangement and of the contact load spring.

* * * * *